United States Patent [19]

Reich, II

[11] Patent Number: 4,489,770

[45] Date of Patent: Dec. 25, 1984

[54] WATERPROOF ENCLOSURE

[75] Inventor: Egon Reich, II, Costa Mesa, Calif.

[73] Assignee: Egon Reich, Newport Beach, Calif.

[21] Appl. No.: 483,490

[22] Filed: Apr. 11, 1983

[51] Int. Cl.[3] ..... B65D 85/38

[52] U.S. Cl. ..... 150/52 R; 150/52 J; 179/146 E

[58] Field of Search ..... 224/236, 257, 258; 150/52 R, 52 J; 179/146 E

[56] References Cited

U.S. PATENT DOCUMENTS 3,665,991 5/1972 Gillemot et al. ..... 150/52 R
4,347,956 9/1982 Berger ..... 150/52 R X
4,412,593 11/1983 Taira ..... 179/146 E X
4,420,078 12/1983 Belt, et al. ..... 150/52 R X
4,431,041 2/1984 Leiserson ..... 150/52 J

*Primary Examiner*—Steven M. Pollard
*Attorney, Agent, or Firm*—Gordon L. Peterson

[57] ABSTRACT

An essentially waterproof enclosure comprising a waterproof bag and a speaker mounted on the wall of the bag. The bag has an opening of sufficient size to permit an electronic sound producing device to be passed through the opening into the interior of the bag. The sound producing device, which may be a radio receiver, can be coupled to the speaker to drive the speaker. The opening can be closed to provide an essentially waterproof environment for the sound producing device.

15 Claims, 5 Drawing Figures

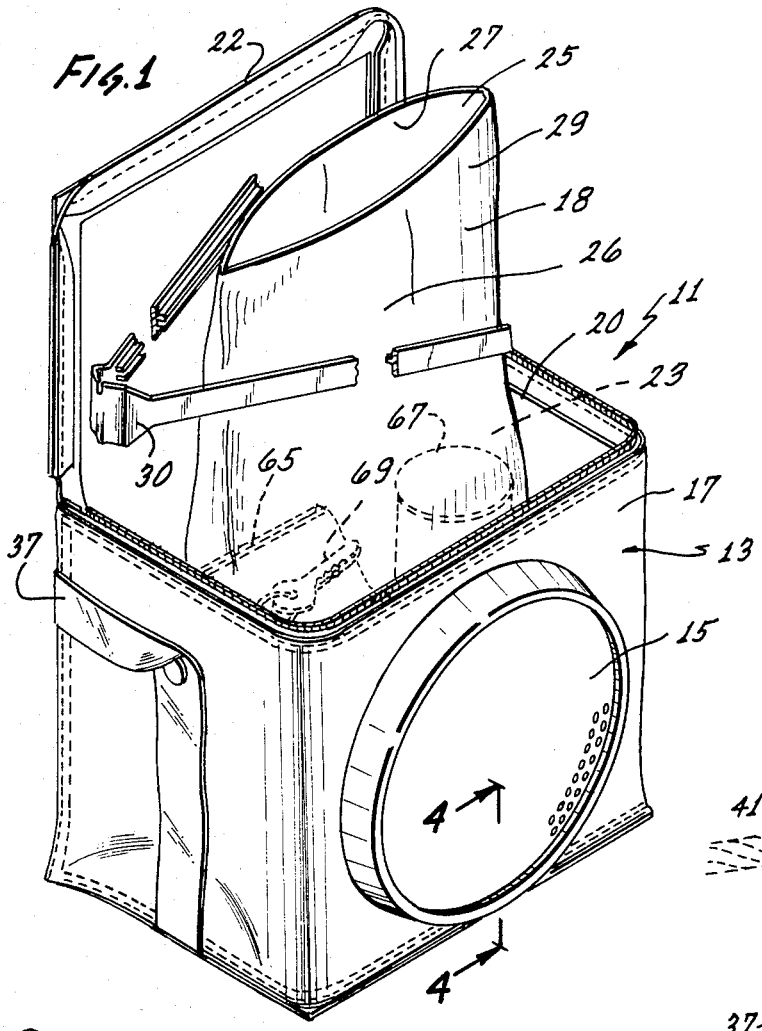
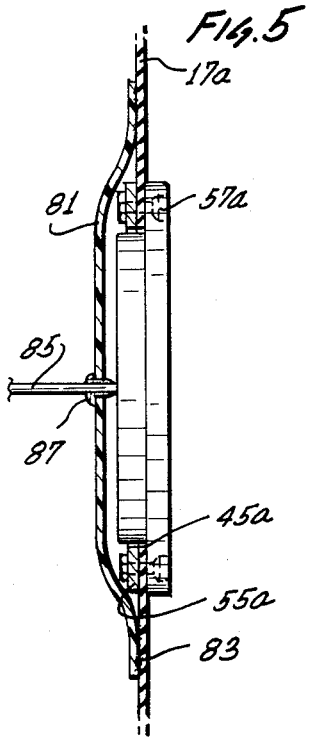
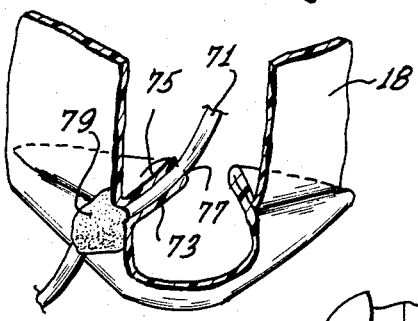
Fig. 3
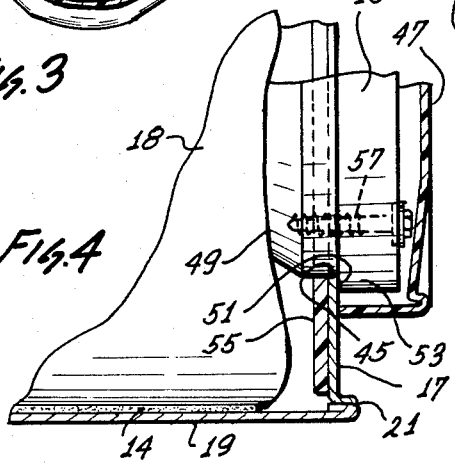
Fig. 4
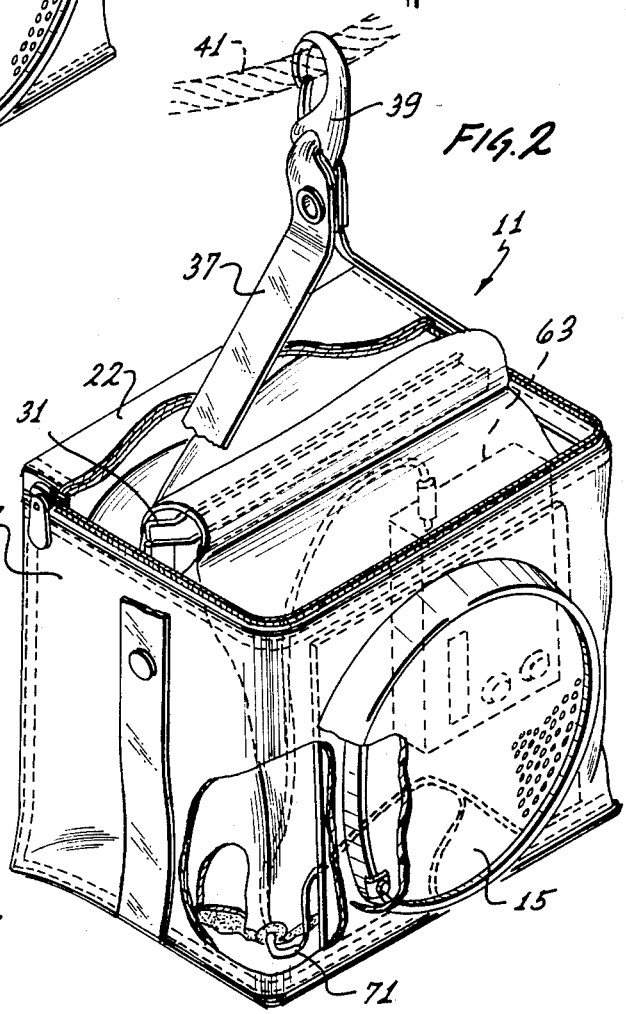

WATERPROOF ENCLOSURE

BACKGROUND OF THE INVENTION

Persons engaged in various aquatic activities such as windsurfing and sailing on small sailboats are impeded in their attempts to use various electronic sound producing devices such as battery operated tape players and radios. A conventional sound producing device cannot be safely used because if the windsurfer or sailboat capsizes, the sound producing device is likely to be lost or damaged. A small portable sound producing device with earphones is likely to suffer the same fate in the event of capsizing.

In an attempt to overcome these problems, it is known to provide a somewhat waterproof enclosure for a small, portable transistor radio. The leads for the earphones project through the container. Although a waterproof enclosure of this type is of some use, it does not enable a single radio to serve all of the passengers nor does it readily permit the use of a radio which does not have earphones.

SUMMARY OF THE INVENTION

This invention provides an essentially waterproof enclosure for a sound producing device such as a radio receiver or tape player which generally overcomes the problems discussed above. With this invention, a speaker is mounted on a wall of the container for projection of sound outside of the container. The container is adapted to enclose, and provide an essentially waterproof environment for, a speaker. Accordingly, this invention enables one to convert a conventional sound producing device into a waterproof sound producing device with a speaker which permits, but does not require, the use of earphones.

The enclosure is essentially waterproof in that it will shield and protect its contents from water spray frequently encountered in sailing and windsurfing and essentially exclude water for reasonable periods even if placed on the water as when the windsurfer or sailboat capsizes.

The enclosure includes a container which is essentially waterproof in the same sense and which has a wall, opening means to provide access to the interior of the container and means to close the opening means so as to make the container essentially waterproof. The enclosure also includes a speaker and means for mounting the speaker on the wall of the container for projection of sound outside of the container. The opening means of the container is of sufficient size to permit a sound producing device to be passed through the opening means into the interior of the container so that the sound producing device can be in an essentially waterproof environment and coupled to the speaker.

To minimize risk of injury, the container is preferably soft, and in a preferred embodiment is a flexible bag of essentially waterproof material. The speaker is also preferably essentially waterproof, and to improve the sound quality is preferably exposed on the outside of the container. It is desirable that the container with the speaker mounted thereon be able to float on water.

In a preferred construction, the wall of the container has an aperture therein and the speaker projects through the opening. The speaker mounting means can advantageously attach the speaker to the wall around the aperture. To assure that the joint between the speaker and the wall does not permit the entry of water, a sheet of essentially waterproof material can be sealed to the wall and cover the aperture and the mounting means on the inner side of the speaker.

The interior of the container should be large enough to house a sound producing device and if desired, some additional items. The sound producing device may or may not include its own speaker, but it is contemplated that the sound producing device will be coupled to the speaker mounted on the bag for projection of sound outside of the enclosure. Of course, the sound producing device can be used with ear plugs when desired by extending the leads for the ear plugs through the opening means of the container. The container advantageouslv has a handle and a hook or a clip for attaching the enclosure to external structures such as a line or other member of a sailboat or a windsurfer.

In a preferred embodiment, the container includes an outer bag and an inner bag within the outer bag with the speaker mounted on the wall of the outer bag. The opening means of the container includes an opening on the inner bag of sufficient size to permit the sound producing device to pass through the opening into the inner bag. The inner bag defines an essentially airtight chamber in which air can be trapped to aid flotation. One or more conductors extend from the speaker through a wall of the inner bag and are sealed to the inner bag.

The invention, together with additional features and advantages thereof may best be understood by reference to the following description taken in connection with the accompanying illustrative drawing.

BRIEF DESCRIPTION OF THE DRAWING

FIG. 1 is a perspective view of an essentially waterproof enclosure constructed in accordance with the teachings of this invention.

FIG. 2 is a perspective view of the enclosure and a portion of a sailboat with portions of the enclosure broken away.

FIG. 3 is an enlarged perspective view of a portion of the inner bag.

FIG. 4 is an enlarged fragmentary sectional view taken generally along line 4—4 of FIG. 1.

FIG. 5 is a sectional view on the plane of line 4—4 showing an alternate construction.

DESCRIPTION OF THE PREFERRED EMBODIMENT

FIG. 1 shows an essentially waterproof enclosure 11 which comprises an essentially waterproof container in the form of a flexible bag 13 and a speaker 15. The bag 13, which can be of any desired configuration includes an outer bag 16 and an inner bag 18, the outer bag 16 has a peripheral wall 17 and a bottom wall 19 (FIG. 4) which may be integral or joined together along a seam 21. The wall 19 is bonded to the bottom wall of the inner bag 18 by adhesive 14 (FIG. 4). The walls 17 and 19 are constructed of flexible waterproof material such as rubber, plastic, waterproof fabric, or a laminate or combination of such materials. The bag 16 has an opening 20 which can be closed by a cover 22 which can be zipped closed to provide an essentially waterproof compartment.

The inner bag 18 has an interior compartment 23 (FIG. 2) and an opening 25 (FIG. 1) to provide access to the compartment 23. The inner bag 18 is of about the same size and shape as the outer bag 16 except it has an enlarged neck 26 which can extend through the opening 20. In the illustrated embodiment,the opening 25 is at the top of the bag 13 and is between opposed wall portions 27 and 29 (FIG. 1) of the neck 26. Although the opening 25 can be closed in different ways, in the illustrated embodiment, this is accomplished by clamping the wall portions 27 and 29 with a conventional clamp 30 and rolling the clamp and wall portions downwardly from the position shown in FIG. 1 to the position shown in FIG. 4 to form a roll 31. The inner bag 18 is preferably constructed of a flexible imperforate plastic material so the compartment 23 is waterproof and airtight. This enables air to be trapped in the compartment 23 to aid flotation.

A handle 37 is attached to the peripheral wall 17 of the bag 13 so that it can project upwardly from the bag. A hook 39 is mounted on the handle 37 so the enclosure 11 can be suspended from external structures such as a line 41 associated with a sailboat or windsurfer.

The speaker 15 is preferably a waterproof speaker. For example, speakers of this type are sold under the trademark Poly-Planar by Electronic Research Associates, Inc., of Moonachie, N.J.

To enable the speaker 15 to be mounted on the wall 17, an aperture 45 is provided in the wall and the speaker projects through the aperture. In this regard, the speaker 15 has a forward face 47 and a rear face 49 which face the exterior of the bag 13 and the compartment 23, respectively. The face 47 is the speaker face which normally faces outwardly for projecting the sound to the listener.

Although the speaker 15 can be mounted on the wall 17 in different ways, in the form illustrated, a peripheral region 51 of the wall 17 is clamped between an annular flange 53 of the speaker and an annular mounting ring 55. As shown in FIG. 3, the flange 53 and the ring 55 are held together by a plurality of threaded fasteners 57.

The opening 25 and the compartment 23 are sized to receive a battery operated transistor radio 63 (FIG. 2) and various other articles such as food 65, drinks 67, and keys 69. The radio 63 is coupled by leads 71 to the speaker 15 with the leads 71 extending through the inner bag 18. With this arrangement, the signal received by the radio 63 is played through the speaker 15. For those instances in which headphones are preferred, the leads for the headphones can extend from the radio 63 through the openings 20 and 25 to the headphones.

To keep the compartment 23 completely air and water tight, it is important to seal the conductor 71 to the inner bag 18. Although this can be accomplished in different ways, in the illustrated embodiment, this is accomplished by overlapping wall portions 73 and 75 (FIG. 3) at a lower corner of the bag 18 and extending the conductor 71 between the wall portions and through an aperture 77 of the inner bag 18. The wall portion 73 may be held in overlapping relationship by a heat seal or an adhesive and liberal quantities of adhesive 79 are provided around the conductor 71 at the wall portions 73 and 75.

The enclosure 11 can be used to convert the radio 63 to an essentially waterproof radio which can be used under a variety of wet conditions. The bag 13 and the speaker 15 are preferably sufficiently buoyant to float on water, and if additional buoyancy is desired, this can be provided in the form of foam plastic blocks suitably associated with the bag 13. The roll 31 seals the opening 25 and can be readily unrolled to provide access to the compartment 23.

FIG. 5 shows an alternate construction in which the inner bag 18 is removed and a sheet 81 of essentially waterproof material is sealed and adhered to the wall 17*a* along a seal line 83. The sheet 81 covers the aperture 45*a*, the ring 55*a* and the fasteners 57*a*. A conductive lead 85 passes through the sheet 81 and is sealed thereto by adhesive 87 so as to maintain the waterproof nature of the sheet 81. In all other respects, the embodiment of FIG. 5 may be substantially identical to the embodiment of FIGS. 1–4.

Although an exemplary embodiment of the invention has been shown and described, many changes, modifications, and substitutions can be made without necessarily departing from the spirit and scope of this invention.

I claim:

1. An essentially waterproof enclosure comprising:

an essentially waterproof container having a wall, opening means to provide access to the interior of the container and means to close the opening means so as to make the container essentially waterproof, said container being a flexible bag of essentially waterproof material;

a speaker;

means for mounting the speaker to the wall of the container for projection of sound outside of the container; and the opening means of the container being of sufficient size to permit an electronic sound producing device to be passed through the opening means into the interior of the container so that the device can be in an essentially waterproof environment and coupled to the speaker.

2. An enclosure as defined in claim 1 wherein said speaker is essentially waterproof and is exposed on the outside of said container.

3. An enclosure as defined in claim 1 wherein said container with said speaker mounted thereon can float on water.

4. An enclosure as defined in claim 1 wherein the wall of the bag includes opposed wall portions at the top of the bag and said opening means is between said wall portions and said means to close the opening means includes means on said bag for retaining said opposed wall portions in a roll.

5. An enclosure as defined in claim 1 wherein the wall has a aperture therein and said speaker projects through the aperture, said mounting means includes means for attaching the speaker to said wall around said aperture.

6. An enclosure as defined in claim 5 including a sheet of essentially waterproof material sealed to the wall and covering said aperture and said mounting means on the inner side of the speaker.

7. An enclosure as defined in claim 1 including handle means attached to the container.

8. An enclosure as defined in claim 1 wherein said container with said speaker mounted thereon can float on water, the wall has an aperture therein and said speaker projects through the aperture and is exposed on the outside of the bag, and said speaker is essentially waterproof.

9. An enclosure is defined in claim 8 wherein said mounting means includes means for attaching the speaker to said wall around said aperture.

10. An enclosure as defined in claim 1 wherein said container includes means for providing an essentially airtight chamber in said container in which air can be trapped to aid flotation, said opening means including an opening in said providing means which is openable and of sufficient size to permit the electronic sound producing device to be passed therethrough into the chamber.

11. An enclosure as defined in claim 1 including conductor means extending from said speaker through said inner bag to the interior of said inner bag and means for sealing the conductor means to the inner bag.

12. An enclosure as defined in claim 11 wherein said inner bag is constructed of a plastic material, portions of said inner bag are retained in overlapping relationship, said conductor means extends between said overlapping portions and said bonding means includes adhesive adjacent said overlapping portions.

13. A waterproof assembly comprising:

an essentially waterproof bag having a wall, opening means to provide access to the interior of the bag and means to close the opening means so as to make the bag essentially waterproof;

a speaker;

means for mounting the speaker on the wall of the bag for projection of sound outside of the bag;

a battery operated electronic sound producing device;

the opening means of the bag being of sufficient size to permit the device to be passed through the opening means into the interior the the bag so that the device can be in an essentially waterproof environment; and means for coupling the device to the speaker.

14. An essentially waterproof enclosure comprising:

an essentially waterproof container having a wall, opening means to provide access to the interior of the container and means to close the opening means so as to make the container essentially waterproof;

a speaker;

means for mounting the speaker to the wall of the container for projection of sound outside of the container;

the opening means of the container being of sufficient size to permit an electronic sound producing device to be passed through the opening means into the interior of the container so that the device can be in an essentially waterproof environment and coupled to the speaker; and said container including an outer bag, an inner bag within said outer bag, said speaker being mounted on the wall of the outer bag and the opening means includes an opening on said inner bag of sufficient size to permit the sound producing device to be passed through the opening into the interior of the inner bag and said closing means includes means for closing said opening.

15. An enclosure as defined in claim 14 including means for bonding a region of said inner bag to a region of said outer bag.

* * * * *